US005358832A

United States Patent [19]

Millington et al.

[11] Patent Number: 5,358,832

[45] Date of Patent: Oct. 25, 1994

[54] FIXING BATH

[75] Inventors: Robert S. Millington, Hazel Grove; Ross Fielding, Knutsford, both of England

[73] Assignee: Ilford Limited, Knutsford, England

[21] Appl. No.: 138,704

[22] Filed: Oct. 18, 1993

[30] Foreign Application Priority Data

Oct. 21, 1992 [GB] United Kingdom ..... 9222048

[51] Int. Cl.[5] ..... G03C 5/38

[52] U.S. Cl. ..... 430/459; 430/455; 430/458

[58] Field of Search ..... 430/455, 458, 459, 393

[56] References Cited

U.S. PATENT DOCUMENTS 4,025,345 5/1977 Kido et al. ..... 430/1

4,390,618 6/1983 Kobayashi et al. ..... 430/543

*Primary Examiner*—Hoa Van Le

*Attorney, Agent, or Firm*—Darby & Darby

[57] ABSTRACT

There is described a fixing bath for developed silver halide photographic material which comprises as the active silver halide solvent a combination of sodium thiosulphate and potassium thiosulphate, the molar ratio of sodium to potassium being from about 2:3 to about 3:2.

6 Claims, No Drawings

FIXING BATH

FIELD OF THE INVENTION

This invention relates to fixing baths for photographic silver halide materials.

BACKGROUND OF THE INVENTION

After silver halide material has been exposed and developed, it is necessary to remove the unexposed and hence undeveloped silver halide remaining in the material to render the material light stable. The most commonly used silver halide solvents used in fixing baths to remove or 'fix-out' the undeveloped silver are either an alkali metal thiosulphate or ammonium thiosulphate. The thiosulphate first used was sodium thiosulphate, the hypo of the old photographic books. More recently, ammonium thiosulphate has been used as it removes the undeveloped silver very much faster than sodium thiosulphate. Potassium thiosulphate has also been proposed to be used, but as it is more expensive than sodium thiosulphate and not much if any faster at fixing out, it has not been used much commercially.

Most often the dissolved or fixed out silver is removed from the fixing solution by electrolysis, ion exchange or other means and the used desilvered fixing solution is discharged into the effluent system. However, for environmental reasons, in recent years the control of effluent has become very strict. Sodium or potassium salts which are very wide-spread in nature do not significantly affect the aqueous environment into which the effluent is discharged but ammonium salts tend to act as a fertilizer for the micro-organisms in the aqueous environment and if such micro-organisms proliferate greatly they reduce the oxygen content of the aqueous environment. This is in detriment to the higher species found in such environment such as fish. Further, when such microorganisms die, this further consumes oxygen and renders the water foul and unfit to support fish or higher-plant life. Thus it is desirable to find a fixing solution which contains no ammonium thiosulphate but which fixes out silver faster than sodium thiosulphate. In the past, various other salts have been used as fixing agents such as alkali metal thiocyanates but in general these are even less environmentally friendly than ammonium thiosulphate.

SUMMARY OF THE INVENTION

We have found a fixing solution that is sufficiently fast-acting and inexpensive to be of use commercially, and, simultaneously, environmentally friendly.

Therefore, according to the present invention, there is provided a fixing bath for developed silver halide photographic material which comprises as the active silver halide solvent a combination of sodium thiosulphate and potassium thiosulphate, the molar ratio of sodium to potassium being from about 2:3 to about 3:2.

DETAILED DESCRIPTION OF THE INVENTION

A useful concentration of alkali thiosulphate salts in the fixing solution is from 0.5 to 1.5 moles/liter. Preferably the concentration is about 1 mole/liter.

Preferably an equal molar amount of sodium and potassium thiosulphite is present.

Such a fixing bath fixes undeveloped silver at an appreciably faster rate than either sodium thiosulphate or potassium thiosulphate used individually (and not in admixture). This is shown in the Example which follows. This was an entirely unexpected result which could not be predicted. It is not clear why this combination of sodium and potassium thiosulphate provides this useful result. The combination of sodium and potassium thiosulphate in the fixing bath of the present invention is not as fast acting as when ammonium thiosulphate is used alone, but a very worth-while improvement is obtained compared to using a fixing bath containing sodium thiosulphate alone or potassium thiosulphate alone.

Any of the usual ingredients often found in fixing baths may be present except that for environmental reasons ammonium thiosulphate or other ammonium salts should be avoided. Examples of such additional ingredients include alkali metal sulphites or bisulphites as anti-oxidants, acetic acid as a buffer and potassium sulphite (alum) as a hardening agent, without limitation. Again, environmentally harmful ingredients should be avoided.

The fixing bath of the present invention is suitable for processing any photographic material, including without limitation photographic materials containing high iodide, as illustrated in the Example below.

Preferably the pH of the fixing solution is from 4 to 5 and most preferably about 5.

The speed of the fixing process is normally determined by the so-called clearing time. That is to say unexposed silver halide film material is treated under standardized conditions with the fixing solution and the time it takes for the optical turbidity caused by the disperse silver halide to disappear and for the film material to become transparent is determined. Optical inspection is usually used to determine the disappearance of turbidity and this method was used in the Example which follows.

EXAMPLE 1

Three types of film were used in this Example.

Type A was a fast film with a high coating weight of silver halide of which 5% by weight was silver iodide.

Type B was a fast film with a high coating weight of silver halide but only 1% of silver iodide.

Type C was a medium speed film with a very much lower coating weight of silver halide than type A or B.

Four fixing solutions were prepared.

Each comprised 40g/liter sulphite and each had a pH of

F.S.1. comprised 129.7g/liter of ammonium thiosulphate.

F.S.2. comprised 138.4g/liter of sodium thiosulphate.

F.S.3. comprised 193.4g/liter of potassium thiosulphate. sulphate.

F.S.4. comprised 69.2g/liter of sodium thiosulphate and 96.7g/liter of potassium thiosulphate. Thus, each solution comprised 1 mole/liter of thiosulphate. Equal area strips of the three films were overall exposed to fully fog them. Then strips of the three films were immersed in the four fixing solutions at 25° C. and the clearing time for each film in each fixing solution was recorded. These results are set forth in the Table below. The cleaning times are in seconds.

| Fixing Solution | 1 | 2 | 3 | 4 |
|---|---|---|---|---|
| Film type A | 42 | 110 | 105 | 65 |

-continued

| Fixing Solution | 1 | 2 | 3 | 4 |
|---|---|---|---|---|
| Film type B | 27 | 109 | 94 | 70 |
| Film type C | 23 | 93 | 168 | 57 |

Thus in all cases F.S.I., which comprises ammonium thiosulphate, is the fastest and has the shortest clearing time.

But in all cases the clearing time for F.S.4., which comprises an equal amount of sodium and potassium thiosulphate, is faster than F.S.2. which contained sodium thiosulphate alone or F.S.3., which contained potassium thiosulfate alone.

Furthermore, in the case of film type A which comprises a relatively high proportion of silver iodide (which is considered hard to fix) the clearing time of F.S.4. approaches that of F.S.1.

What is claimed is:

1. A fixing bath for developed silver halide photographic material which comprises as the active silver halide solvent a combination of sodium thiosulphate and potassium thiosulphate, the molar ratio of sodium to potassium being from 2:3 to about 3:2, and the total thiosulphate content being from about 0.05 to about 1.5 moles/liter.

2. A fixing bath according to claim 1 wherein said molar ratio is 1:1.

3. A fixing bath according to claim 1 comprising 1 mole/liter of said thiosulphates.

4. A fixing bath according to claim 1 having a pH within the range from 4 to 6.

5. A fixing bath according to claim 2 comprising 1 mole/liter of said thiosulphates.

6. A fixing bath according to claim 1 having a pH of 5.

* * * * *